US009781514B2

(12) United States Patent
Hensen

(10) Patent No.: US 9,781,514 B2
(45) **Date of Patent: *Oct. 3, 2017**

(54) STEREO AUDIO HEADPHONE APPARATUS

(71) Applicant: K&E Holdings, LLC, Lakeland, FL (US)

(72) Inventor: Eric Logan Hensen, Lakeland, FL (US)

(73) Assignee: K&E Holdings, LLC, Lakeland, FL (US)

( * ) Notice: Subject to any disclaimer, the term of this patent is extended or adjusted under 35 U.S.C. 154(b) by 53 days.

This patent is subject to a terminal disclaimer.

(21) Appl. No.: 14/878,601

(22) Filed: Oct. 8, 2015

(65) Prior Publication Data

US 2016/0080868 A1 Mar. 17, 2016

Related U.S. Application Data

(63) Continuation-in-part of application No. 12/731,397, filed on Mar. 25, 2010, now Pat. No. 9,161,131.
(Continued)

(51) Int. Cl.
*H04R 5/02* (2006.01)
*H04R 25/00* (2006.01)
(Continued)

(52) U.S. Cl.
CPC ..... *H04R 5/033* (2013.01); *H04R 5/04* (2013.01); *H04R 25/552* (2013.01); *H04R 2205/041* (2013.01); *H04R 2420/07* (2013.01)

(58) Field of Classification Search
CPC ..... H04R 5/033; H04R 5/04; H04R 25/552; H04R 2205/041; H04R 2420/07
See application file for complete search history.

(56) References Cited

U.S. PATENT DOCUMENTS 4,985,925 A 1/1991 Langberg et al.
5,610,988 A 3/1997 Miyahara
(Continued)

OTHER PUBLICATIONS

PCT International Searching Authority, International Search Report for related application PCT/US16/55489 dated Jan. 16, 2017 (4 pages).

(Continued)

*Primary Examiner* — Andrew L Sniezek
(74) *Attorney, Agent, or Firm* — Mark Malek; Daniel Pierron; Widerman Malek, P.L.

(57) ABSTRACT

A stereo audio headphone apparatus comprising a master headphone unit comprising a master housing, master circuitry comprising a stereo audio source and a wireless transmitter, a master audio output device for playing a first stereo audio channel, a master audio input device, and a first independently settable frequency equalizer for the first stereo audio channel carried by the master housing, and a slave headphone unit comprising a slave housing, slave circuitry comprising a wireless receiver, a slave audio output device for playing a second stereo audio channel, a slave audio input device, and a second independently settable frequency equalizer for the second stereo audio channel carried by the slave housing. The master and slave circuitries are operable in a pass-through mode with audio sensed by the master and slave audio input devices being delivered to the master and slave audio output devices via the first and second frequency equalizers.

15 Claims, 12 Drawing Sheets

Related U.S. Application Data

(60) Provisional application No. 62/061,497, filed on Oct. 8, 2014.

(51) Int. Cl.
*H04R 5/033* (2006.01)
*H04R 5/04* (2006.01)

(56) References Cited

U.S. PATENT DOCUMENTS

| | | | | |
|---|---|---|---|---|
| 5,987,146 | A | 11/1999 | Pluvinage et al. | |
| 6,292,560 | B1 | 9/2001 | Gligoric | |
| 6,546,109 | B1 * | 4/2003 | Gnecco | H04R 25/652 174/353 |
| 7,206,429 | B1 | 4/2007 | Vossler | |
| 7,734,055 | B2 | 6/2010 | Chiloyan | |
| 7,783,068 | B2 | 8/2010 | Klemenz et al. | |
| 7,930,135 | B2 | 4/2011 | Ma et al. | |
| 8,117,888 | B2 | 2/2012 | Chan et al. | |
| 8,979,762 | B2 | 3/2015 | Ma et al. | |
| 9,161,131 | B2 * | 10/2015 | Hensen | H04R 5/033 |
| 9,392,351 | B2 | 7/2016 | Liao et al. | |
| 2007/0037615 | A1 | 2/2007 | Glezerman | |
| 2007/0147630 | A1 * | 6/2007 | Chiloyan | H04M 1/6066 381/74 |
| 2010/0222639 | A1 * | 9/2010 | Purcell | H04R 25/606 600/25 |
| 2015/0182135 | A1 | 7/2015 | Ma et al. | |

OTHER PUBLICATIONS

PCT International Searching Authority, Written Opinion for related application PCT/US16/55489 dated Jan. 16, 2017 (5 pages).

* cited by examiner

STEREO AUDIO HEADPHONE APPARATUS

RELATED APPLICATIONS

This application is a continuation-in-part and claims the benefit under 35 U.S.C. §120 of U.S. patent application Ser. No. 12/731,397 filed Mar. 25, 2010 titled Stereo Audio Headphone Apparatus for a User Having a Hearing Loss and Related Methods, the content of which is incorporated in its entirety, except to the extent disclosure therein is inconsistent with disclosure herein. Additionally, this application claims the benefit under 35 U.S.C. §119(e) of U.S. Provisional Patent Application Ser. No. 62/061,497 filed Oct. 8, 2014 titled Ear-Mounted Device With Integrated Pulse Oximetry And Associated Methods, the content of which is incorporated in its entirety, except to the extent disclosure therein is inconsistent with disclosure herein.

FIELD OF THE INVENTION

The present invention relates to the field of stereo audio, and, more particularly, to stereo audio headphone devices and related methods.

BACKGROUND OF THE INVENTION

A portable stereo audio playing device has become increasingly popular among people for entertainment. For example, a person may use a portable stereo audio playing device for entertainment while exercising at a gym, during a period of long travel, or during periods of inactivity.

A typical portable stereo audio playing device may include a housing and a memory for storing digital music data. The portable audio playing device may also include a controller for playing back the stored digital music data. Inputs for controlling the music selection and output volume, for example, may be carried by the housing. A port for coupling wired headphones or earphones for audio output is also typically carried by the housing. One example of a portable stereo audio playing device may be the Ipod® from the Apple Corporation of Cupertino, Calif.

Another type of portable stereo audio playing device may include a pair of housings, each one of the pair worn over a respective ear of a user. Headphones or earphones (audio output transducers) may be integrated into the housings. A structural support member that is worn on a user's head, or extends around a user's head, typically couples the housings. The structural support member may also interfere with a person's mobility, for example, while exercising, and more particularly, if protective head equipment is worn, for example.

U.S. Patent Application Publication No. 2007/0037615 to Glezerman discloses first and second earpieces. The first earpiece includes a speaker and a first module for communicating with an electronic device, for example, a cellular phone. A second module transmits a signal to a second earpiece. The second earpiece includes a receiver to receive signals from the second module and a speaker.

U.S. Pat. No. 7,206,429 to Vossler discloses an audio player that includes a first ear module that includes components (speaker, microphone, memory, battery) for playing digital music. The ear module is coupled to a hub, which is worn on the lobe of the ear and can provide digital audio signals to the ear module, as well as interface with peripheral devices, such as Bluetooth transceivers. A second ear module may be provided and may coordinate with the first ear module to play audio via wireless communication provided by a peripheral device, within the ear modules themselves, or within the hub. In some embodiments, the circuitry in the hub is disclosed as being incorporated in the housings.

Still further, a typical portable stereo audio playing device may not address a user's hearing shortcomings. For example, a typical portable stereo audio playing device may not include detailed adjustments for sound quality beyond volume, bass, and treble. More particularly, a person that may have hearing loss for example, may not be able to hear or enjoy audio played from a typical audio playing device, or listen to music having a reduced quality.

Moreover, a typical portable audio playing device may not address fitment. In other words, a typical portable stereo audio playing device may not increase comfort, reduce strain on the physical ear, and reduce stress within an ear canal, while improving audio quality, especially for a person that suffers from hearing loss.

SUMMARY OF THE INVENTION

In view of the foregoing background, it is therefore an object of the present invention to provide frequency equalized stereo audio to a hearing impaired user.

This and other objects, features, and advantages in accordance with the present invention are provided by a stereo audio headphone apparatus for a user having hearing loss that may include a master headphone unit including a master housing to be independently carried behind an ear of the user, and master circuitry carried by the master housing. The master circuitry may include a stereo audio source and a wireless transmitter coupled thereto. The master headphone unit may also include a master audio output device carried by the master housing and coupled to the master circuitry for playing a first stereo audio channel from the stereo audio source.

The stereo audio headphone apparatus may also include a slave headphone unit including a slave housing to be independently carried behind another ear of the user, and slave circuitry carried by the slave housing. The slave circuitry may include a wireless receiver cooperating with the wireless transmitter. The slave headphone unit may also include a slave audio output device carried by the slave housing and coupled to the slave circuitry for playing a second stereo audio channel from the stereo audio source.

The stereo audio headphone apparatus may also include first and second independently set table frequency equalizers for the first and second stereo audio channels to permit independent selection of frequency equalization to compensate for the hearing loss of the user. Accordingly, the stereo audio headphone apparatus provides frequency equalized stereo audio to a hearing impaired user.

The first independently set table equalizer may be carried by the master housing, for example. The second independently settable equalizer may also be carried by the slave housing. Alternatively, the first and second independently settable equalizers may be both carried by the master housing.

The master headphone unit may further include a master audio input device carried by the master housing and coupled to the master circuitry. The master circuitry may be operable in a pass-through mode with audio sensed by the master audio input device being delivered to the master audio output device via the first independently settable equalizer, for example. The slave headphone unit may similarly include a slave audio input device carried by the slave housing and coupled to the slave circuitry. The slave circuitry may also be operable in the pass-through mode with audio sensed by the slave audio input device being delivered to the slave audio output device via the second independently settable equalizer, for example.

The master circuitry may also be operable in an impulse noise rejecting pass-through mode to reject impulse noise. The slave circuitry may also be operable in the impulse noise rejecting pass-through mode.

The master audio output device may include a master electrical-to-acoustical (E/A) transducer and a master audio delivery tube having a proximal end coupled to the master E/A transducer and a distal end to be positioned adjacent an ear canal of the user, for example. The slave audio output device may include a slave E/A transducer, and a slave audio delivery tube having a proximal end coupled to the slave E/A transducer and a distal end to be positioned adjacent another ear canal of the user. The master audio output device may further include a master ear fitting coupled to the distal end of the master audio tube, and the slave audio output device may further include a slave ear fitting coupled to the distal end of the slave audio tube, for example.

The master audio delivery tube may be selectively extendible from adjacent portions of the master housing. The slave audio delivery tube may also be selectively extendible from adjacent portions of the slave housing, for example.

Alternatively, the master audio output device may include a master electrical-to-acoustical (E/A) transducer to be positioned adjacent an ear canal of the user, for example. The slave audio output device may also include a slave E/A transducer to be positioned adjacent another ear canal of the user.

The master audio output device may also include a master ear fitting coupled to the master E/A transducer. The slave audio output device may also include a slave ear fitting coupled to the slave E/A transducer.

The master housing may have an arcuate shape. The slave housing may also have an arcuate shape, for example. The stereo audio headphone apparatus may also include a remote control unit operatively coupled to at least one of the master and slave headphone units, such as via a wired or wireless link, for example.

The master headphone unit may include a master rechargeable power supply coupled to the master circuitry. The slave headphone unit may also include a slave rechargeable power supply coupled to the slave circuitry. The stereo audio headphone apparatus may also include a recharging station to receive the master and slave headphone units for recharging the master and slave rechargeable power supplies, respectively, for example.

A method aspect is directed to a method for compensating for hearing loss of a user. The method may include providing a master headphone unit including a master housing to be independently carried behind an ear of the user, master circuitry carried by the master housing and including a stereo audio source and a wireless transmitter coupled thereto, and a master audio output device carried by the master housing and coupled to the master circuitry for playing a first stereo audio channel from the stereo audio source.

The method may also include providing a slave headphone unit including a slave housing to be independently carried behind another ear of the user, slave circuitry carried by the slave housing and including a wireless receiver cooperating with the wireless transmitter, and a slave audio output device carried by the slave housing and coupled to the slave circuitry for playing a second stereo audio channel from the stereo audio source, for example. The method further includes independently setting first and second independently set table frequency equalizers for the first and second stereo audio channels to compensate for the hearing loss of the user.

DETAILED DESCRIPTION

Figure 1:
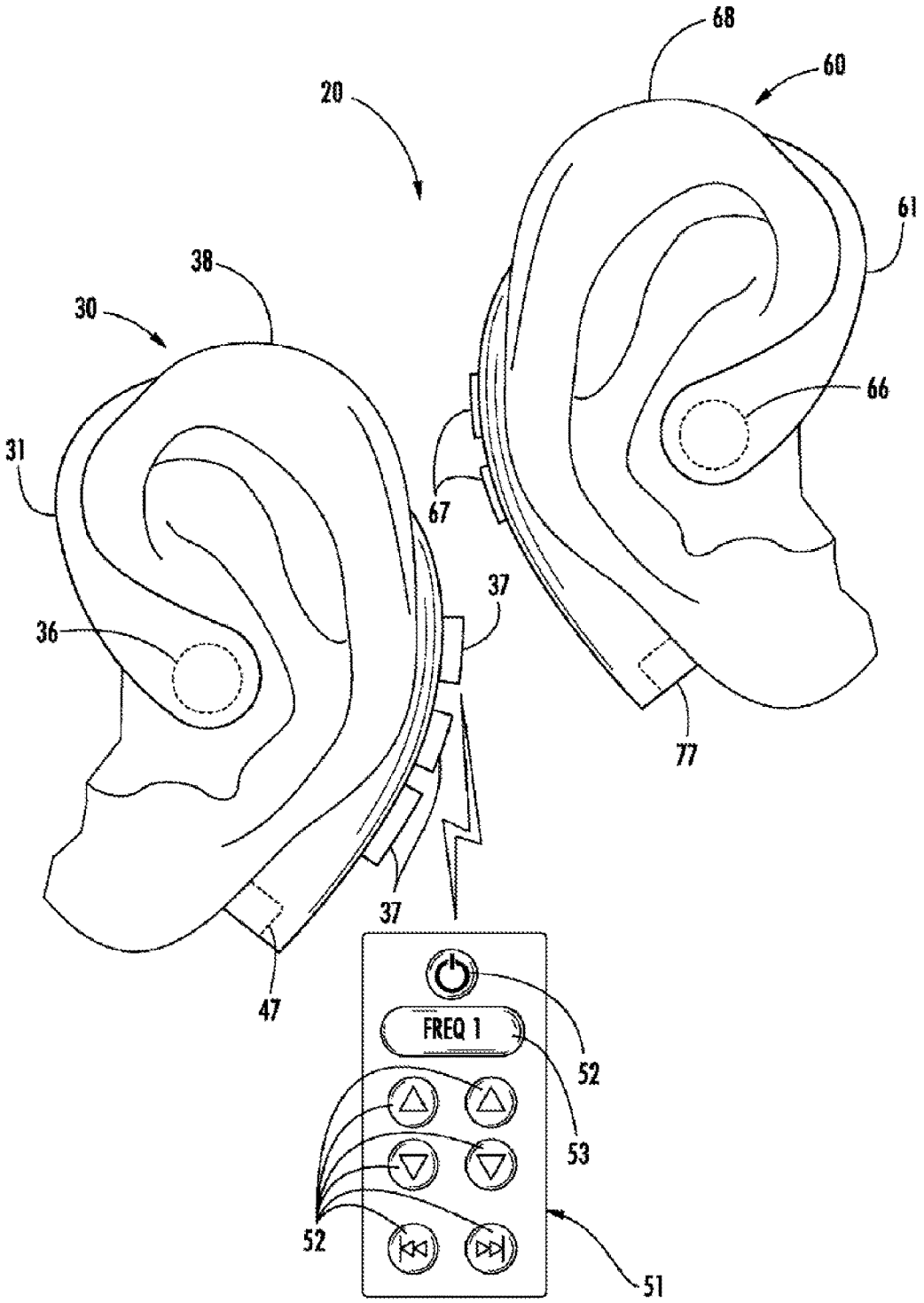
FIG. 1 is an elevational view of a stereo audio headphone apparatus in accordance with the present invention.
Figure 2:
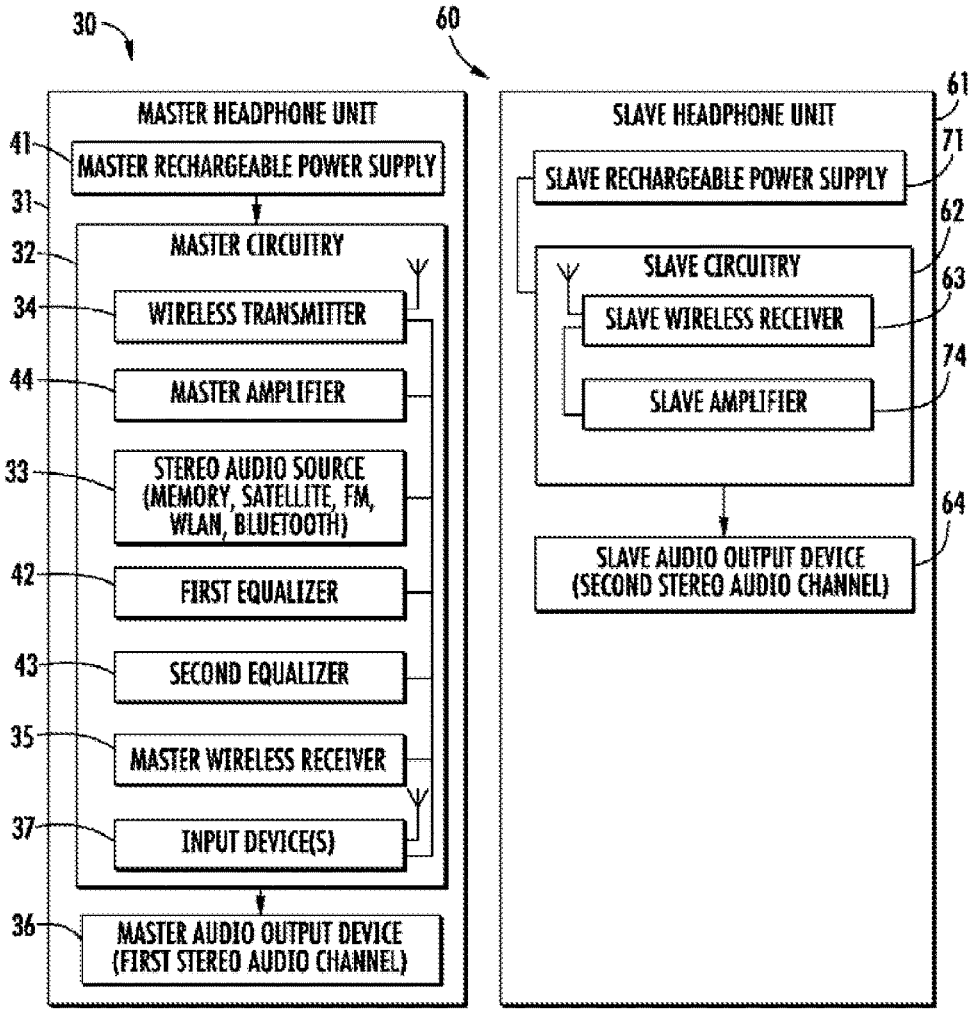
FIG. 2 is schematic block diagram of the stereo audio headphone units of the apparatus of FIG. I.
Figure 3:
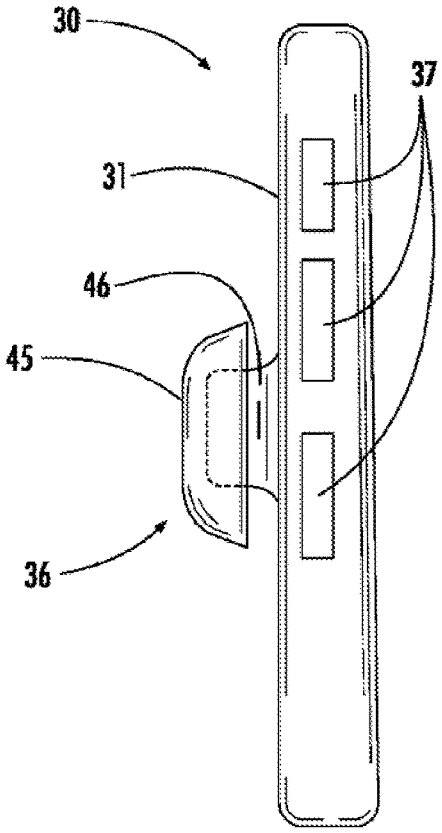
FIG. 3 is a rear elevational view of a stereo audio headphone of FIG. 1.
Figure 4:
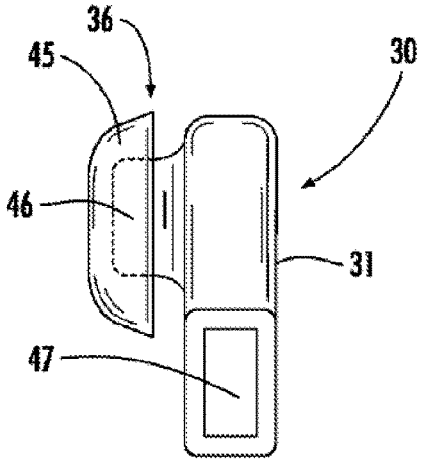
FIG. 4 is a bottom view of the stereo audio headphone of FIG. 3.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Referring initially to FIGS. 1-4, a stereo audio headphone apparatus 20 for a user having hearing loss illustratively includes a master headphone unit 30 that, in turn, includes a master housing 31 independently carried behind an ear 38 of the user. The master housing 31 is a behind the ear (BTE) housing and is arcuate in shape. The master housing 31 fits over the root of the helix of the user's ear, as will be appreciated by those skilled in the art. The master housing 31 may be another type of housing, for example, an in-the-canal housing.

Master circuitry 32 is carried by the master housing 31. The master circuitry includes a stereo audio source 33 and a wireless transmitter 34 coupled thereto. The stereo audio source 33 may be a memory, for example, and may store stereo audio data. The memory may be fixed or may be removable, for example, a secure digital (SD) memory card. Other types of memory, may be used.

The stereo audio data that may be stored in a memory or provided by the stereo audio source may be mpeg layer 3 (mp3) encoded data, for example. Other types of stereo audio data or other data may be stored in the memory.

The stereo audio source 33 may be a stereo audio wireless receiver. For example, the stereo audio wireless receiver may be a frequency modulation (FM) stereo receiver and may transmit stereo FM radio. The stereo audio wireless receiver may also be a satellite receiver for receiving a stereo audio satellite transmission. Still further, the stereo audio wireless receiver may be a Bluetooth or wireless local area network (WLAN) receiver to wirelessly receive stereo audio therefrom, for example, as may be transmitted from a mobile wireless communications device (i.e. cellular telephone), or over an Internet transmission. The stereo audio wireless receiver may be another type of wireless receiver, a combination of wireless receivers, and the stereo audio source 33 may be a combination of a stereo audio wireless receiver and/or memory to provide stereo audio from more than one stereo audio source.

The master headphone unit 30 also includes a master audio output device 36 carried by the master housing 31. The master audio output device 36 is coupled to the master circuitry 32 for playing a first stereo audio channel. The master audio output device 36 may be a master electrical-to-acoustical (E/A) transducer 46 (i.e. speaker). The master audio output device 36 and the portion of the master housing 31 carrying the master output device are adjacent the user's ear canal, i.e. the opening of the user's ear (FIG. 1). A master amplifier 44 may cooperate with the stereo audio source 33 to amplify the first stereo audio channel for playback via the master audio output device.

Input devices 37 are illustratively carried by the master housing 31. The input devices 37 may be push buttons and may be coupled to the master circuitry 32. The input devices 37 may be for adjusting volume, and stereo audio source selection. For example, if the stereo audio source is a memory having stereo audio (music) stored thereon, a selected one of the input devices 37 may be for skipping to another song, or fast-forwarding through a song. Other types of input devices may be used and may correspond to different command and/or function, as will be appreciated by those skilled in the art.

The master headphone unit 30 also includes a master rechargeable power supply 41 coupled to the master circuitry 32 for providing power thereto. The master rechargeable power supply may be a rechargeable battery, for example, a nickel-cadmium (NiCad) or lithium ion (Li-ion) rechargeable battery. Other types of rechargeable power supplies may be used, as will be appreciated by those skilled in the art.

The wireless transmitter 34 of the master circuitry 32 may operate in anyone of different frequency ranges, for example, 2.4 GHz or 5.8 GHz, similar to cordless phones. The wireless transmitter may be a digital wireless transmitter, or an analog wireless transmitter. The wireless transmitter 34 cooperates with the stereo audio source 33 to transmit a second stereo audio channel to a slave headphone unit 60.

The slave headphone unit 60 illustratively includes a slave housing 61. The slave housing 61 is illustratively similar to the master housing 31 in size and shape, but the slave housing is configured to be independently carried behind another ear 68 of the user.

Slave circuitry 62 is also carried by the slave housing 61 and includes a slave wireless receiver 63 cooperating with the wireless transmitter 34. The slave wireless receiver 63 is configured to receive stereo audio, or the second stereo audio channel transmitted from the wireless transmitter 34, and is configured at an operating frequency corresponding to the wireless transmitter.

The slave headphone unit 60 also includes a slave audio output device 64. The slave audio output device 64 is carried by the slave housing 61 and coupled to the slave circuitry 62 for playing the second stereo audio channel. As will be appreciated by those skilled in the art, the slave housing 61, and the slave audio output device 64 may be similar to the corresponding elements in the master headphone unit 30. For example, the slave audio output device 64 may also be an E/A transducer 76 that is positioned adjacent another ear canal of the user's other ear. Additional components present in the master headphone unit 30 may also be present in the slave headphone unit 60, for example, a slave rechargeable power supply 71, and slave input devices 67. A slave amplifier 74 may also cooperate with the stereo audio received by the slave wireless receiver 63 to amplify it for playback via the slave audio output device 64.

The master circuitry 32 also includes first and second independently settable frequency equalizers 42, 43 for the first and second stereo channels to permit independent selection of frequency equalization to compensate for the hearing loss of the user. For example, the frequency equalization of a plurality of frequency bands could be independently selected according to a user's hearing loss parameters, as may be determined by an audiogram, for example. The first and second independently settable frequency equalizers 42, 43 are illustratively both carried by the master housing 31.

Alternatively or additionally, the frequency equalization may also be independently selected according to a user's personal acoustical preferences. still further, alternatively or additionally, the frequency equalization may be independently selected for stereo audio fluctuation based upon a type of ear fitting, as will be described in further detail below.

In some embodiments, for example, five to six bands of frequency equalization may be independently selected to accommodate hearing loss, and may also further accommodate personal acoustical preferences, and stereo audio fluctuation. Of course, any number of bands of frequency equalization may be independently selected to accommodate hearing loss. Independent selection of frequency equalization may include independently or selectively amplifying or attenuating a number of frequency bands.

For example, where five bands of frequency equalization are to be independently selected, each frequency band may be equally divided and may be 3996 Hz wide from 20 Hz-20 kHz, the audible spectrum. In some embodiments, the frequency bands may be divided unequally. For example, the audible spectrum may be divided into bands from 20 Hz-3 kHz, 3-4 kHz, 4-5 kHz, 5-8 kHz, and 8-20 kHz. As will be appreciated by those skilled in the art, a user's hearing is less sensitive to frequencies above 8 kHz and more sensitive to frequencies between 2-5 kHz, so it may be particularly advantageous to include smaller bands for independent selection frequency equalization in the 2-5 kHz range. Of course, each of the frequency bands may include any range of frequencies and be from any portion of the audible spectrum.

As will be appreciated by a person skilled in the art, a user may have 30 to 40 dB of hearing loss across different portions of the audible spectrum, 20 Hz-20 kHz. A user with normal hearing may desire stereo audio, for example stereo music, at 75 to 85 dB. The hearing impaired user may add 30 dB to 40 dB of additional gain by independently selecting the frequency equalization to 75 dB to 85 dB across selected frequency bands to compensate for hearing loss. An overall output, for the user with hearing loss, of about 125 dB may be produced. In some instances, it may be possible to have an overall output of 135 dB to 140 dB based upon a type of ear fitting 45.

Figure 5B:
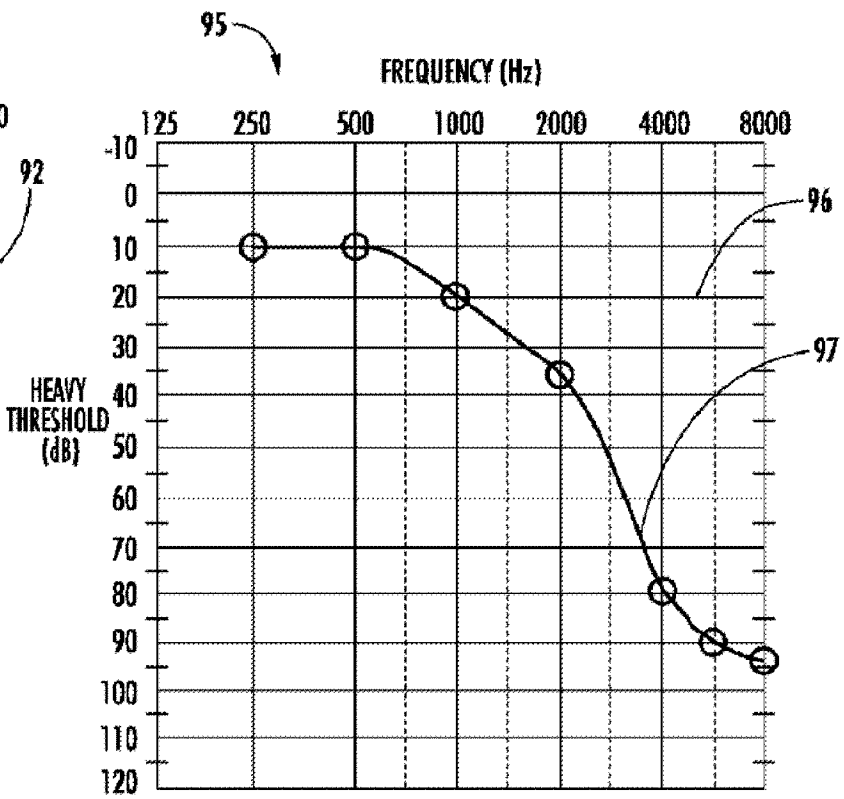
FIG. 5*a*-5*b* are graphs of a hearing threshold across different frequencies for a user's left and right ears.
Figure 5A:
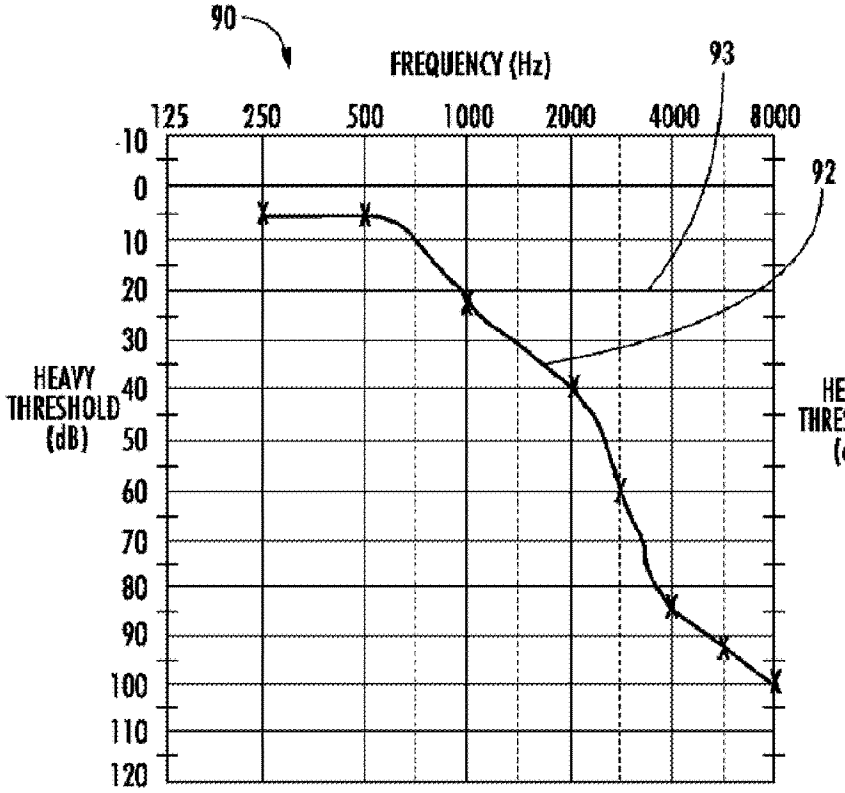

Referring now additionally to the graphs 90, 95 in FIGS. 5*a* and 5*b*, respectively, independent hearing thresholds across different frequencies for a user's left and right ears are illustrated. A user's left ear measured hearing threshold 92 illustratively decreases from a normal threshold level as frequencies. As will be appreciated by those skilled in the art, a normal hearing level ranges from 0 to 25 dB, for example. Similarly, a user's right ear measured hearing threshold 97, also illustratively decreases from a normal threshold level as frequencies.

To compensate for the user's hearing loss, the frequency equalization at different frequencies may be independently selected to a desired level 93, 96. For example, for a desired equalization level of 20 dB for the user's left ear, an attenuation of 15 dB of the band including 250 Hz, and a gain of about 80 dB of the band including 8 kHz would be needed. Additionally, for example, for a desired equalization level or hearing threshold level of 20 dB for the user's right ear, an attenuation of 10 dB of the band including 250 Hz, and a gain of about 75 dB of the band including 8 kHz would be needed. As will be appreciated by those skilled in the art, attenuating selected frequency bands may reduce distortion when the overall volume or gain across all frequencies is increased. Of course, other desired hearing threshold levels may be used, and the frequencies extending through the audible spectrum may be measured and independently equalized.

Referring now additionally to the graphs 90, 95 in FIGS. 5*a* and 5*b*, respectively, independent hearing thresholds across different frequencies for a user's left and right ears are illustrated. A user's left ear measured hearing threshold 92 illustratively decreases from a normal threshold level as frequencies. As will be appreciated by those skilled in the art, a normal hearing level ranges from 0 to 25 dB, for example. Similarly, a user's right ear measured hearing threshold 97, also illustratively decreases from a normal threshold level as frequencies.

To compensate for the user's hearing loss, the frequency equalization at different frequencies may be independently selected to a desired level 93, 96. For example, for a desired equalization level of 20 dB for the user's left ear, an attenuation of 15 dB of the band including 250 Hz, and a gain of about 80 dB of the band including 8 kHz would be needed. Additionally, for example, for a desired equalization level or hearing threshold level of 20 dB for the user's right ear, an attenuation of 10 dB of the band including 250 Hz, and a gain of about 75 dB of the band including 8 kHz would be needed. As will be appreciated by those skilled in the art, attenuating selected frequency bands may reduce distortion when the overall volume or gain across all frequencies is increased. Of course, other desired hearing threshold levels may be used, and the frequencies extending through the audible spectrum may be measured and independently equalized.

The stereo audio headphone apparatus 20 illustratively includes a remote control unit 51 that is operatively coupled to the master headphone unit 30 (FIG. 1). The remote control unit 51 illustratively communicates with a master wireless receiver 35. Alternatively, the remote control unit 51 may communicate with the stereo audio source 33 when it is configured as a stereo audio wireless receiver of the stereo audio source. The remote control unit 51 may also communicate with the slave wireless receiver 63, or a second slave wireless receiver (not shown).

The remote control unit 51 may be a radio frequency (RF) remote control unit, or in some embodiments, the remote control unit may be an infrared (IR) remote control unit. Additionally, the remote control unit 51 may not be wireless and may be wired to either or both the master and slave headphone units 30, 60.

The remote control unit 51 is configured to transmit commands, for example, to the master wireless receiver 35. Commands that may be transmitted include volume, and stereo audio source selection. For example, if the stereo audio source 33 is a memory having music stored thereon, the remote controller 43 may send commands for skipping to another song, or fast-forwarding through a song. The remote control unit 43 may also send commands relating to the independent selection of the frequency equalization for the first and second stereo audio channels.

The remote control unit 51 also illustratively includes remote control unit input devices 52, for example, push buttons, that correspond to the commands. The remote control unit 51 also includes a display 53 that may display information about the stereo audio source 33, for example, a song title or artist, or information about the stereo audio headphones, for example, volume and/or battery power remaining. The remote control unit 51 may advantageously send commands corresponding to ones of the input devices 37. Of course, the remote control unit 51 may send other commands and may display other information.

Figure 6:
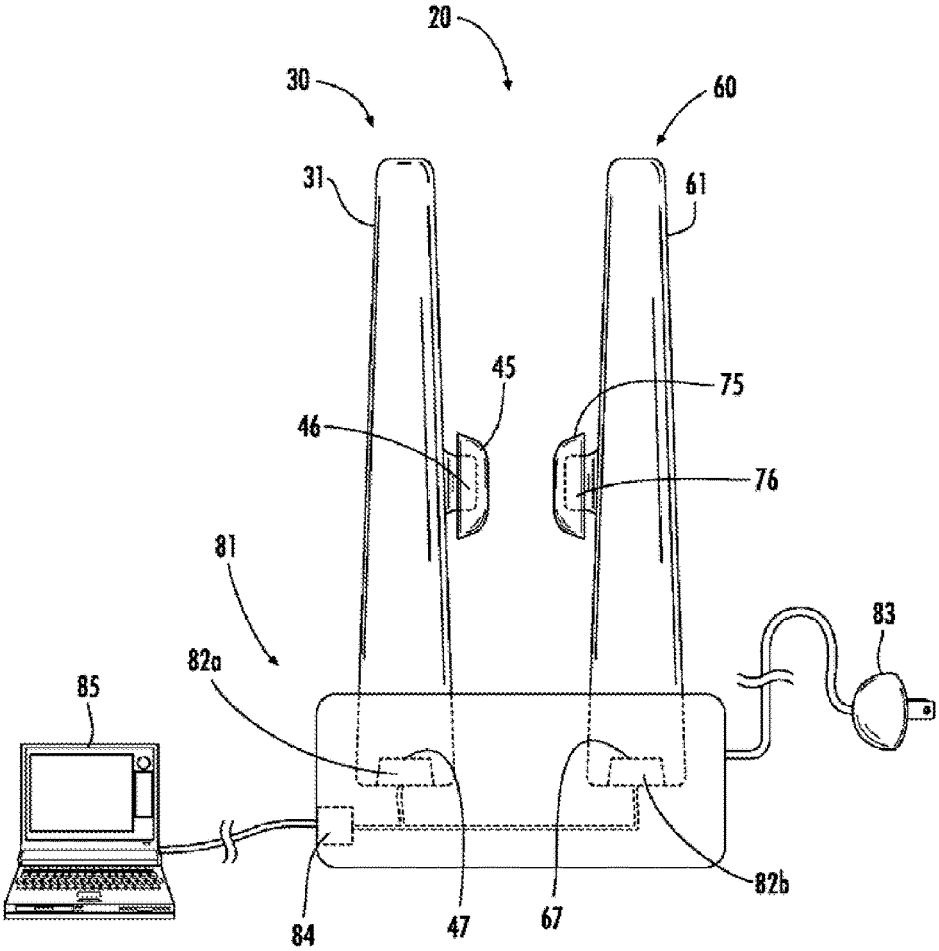
FIG. 6 is a schematic diagram of the stereo audio headphone apparatus of FIG. 1 positioned in a recharging station and coupled to a personal computer in accordance with the present invention.

Referring now additionally to FIG. 6, the stereo audio headphone apparatus 20 also includes a recharging station 81 configured to receive the master and slave headphone units 30, 60 for recharging the master and slave rechargeable power supplies 41, 71, respectively. The recharging station 81 includes a power source connector 83 for coupling to a power supply, for example, an electrical wall outlet.

Illustratively, the recharging station 81 includes a pair of recharging station headphone unit connectors 82*a*, 82*b* for coupling to respective master and slave headphone unit recharging station ports 47, 67. The master and slave headphone unit recharging station ports 47, 67 are carried by their respective housings 31, 61. More particularly, the master and slave headphone unit recharging station ports 47, 67 are illustratively recessed within their respective housings 31, 61. This advantageously reduces the overall size of each housing 31, 61 and may also reduce snagging for example, as opposed to a connector extending from the housing. Thus, a user's comfort is also increased.

The recharging station 81 includes a recharging station data connector 82 for coupling to a personal computer 85, for example. Of course, the computer may be a portable computer, or other type of communications device, communications device. for example, a mobile wireless The recharging station data connector 84 may be a universal serial bus (USB) connector, and connect to a USB port of the personal computer 85, for example. Other types of connectors or data buses may be used.

Data communicated via the recharging station data connector 84 may be sent to and stored in the stereo audio headphone units 30, 60 from the personal computer 85 when the stereo headphone units are coupled to the recharging station 81. More particularly, the first and second independently settable frequency equalizers 42, 43 for the first and second stereo channels may be set to compensate for the user's hearing loss via the personal computer 85. Other data, for example, stereo audio data or data related thereto, may be loaded to the stereo audio source 33.

Additionally, in the case of a USB data bus or cable, the power source connector 83 may not be needed, as charging may also be performed over the recharging station data connector 84. Where the recharging station 81, including the master and slave stereo headphone units 30, 60 coupled thereto, are coupled to a personal computer 85, for example, a computer program stored on a computer-readable medium may be used to load the data. The computer-readable medium may include a physical drive or memory, as will be appreciated by those skilled in the art.

Figure 7:
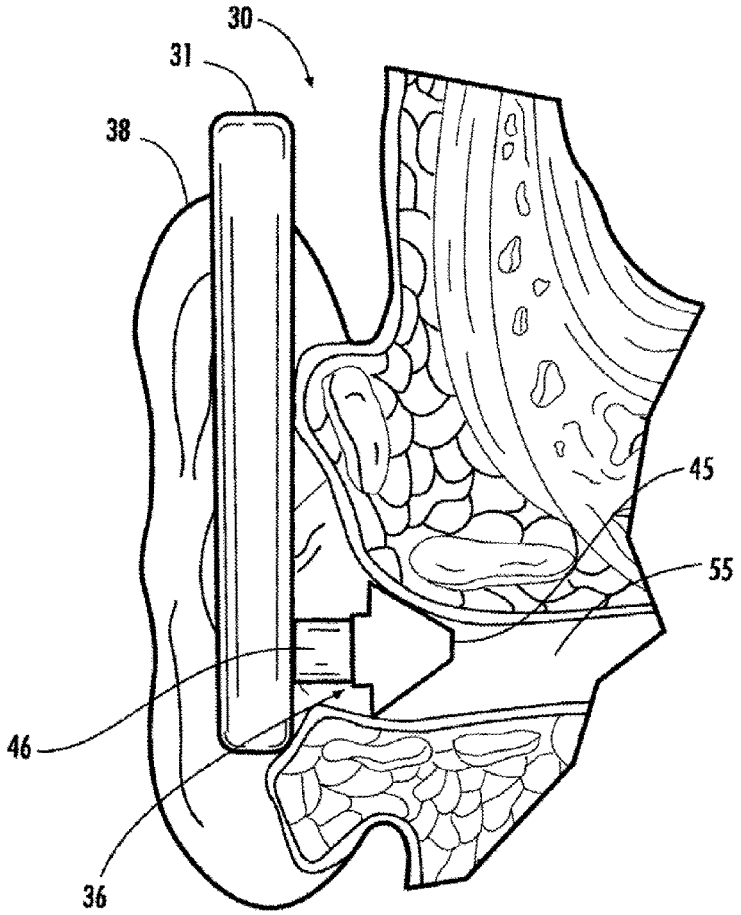
FIG. 7 is a partial cross-sectional view of a user's ear with a stereo audio headphone unit coupled thereto in accordance with the present invention.

Referring now additionally to FIGS. 7-8, the master audio output device 36 may also include a master ear fitting 45 coupled to the master E/A transducer 46 adjacent the user's ear canal 55. The master ear fitting 45 may be removably coupled to the master E/A transducer 37 for placement inside the ear canal 55 of the user. As will be appreciated by those skilled in the art, the removable master ear fitting 45 may be one of a plurality of interchangeable removable ear fittings. A different removable master ear fitting may be desired for different applications, for example, exercise and a helmet-requiring activity, and based upon the sound level of the environment, for example, a gym, or noisy activity.

The master ear fitting 45 may be formed of a deformable elastomer. The master ear fitting 45 is flexible so that as a user talks or chews, the master ear fitting will flex with the user's mandible and with the movement of the external portion of the user's ear canal. The master ear fitting 45 may be formed of another material, as will be appreciated by those skilled in the art.

Figure 8A:
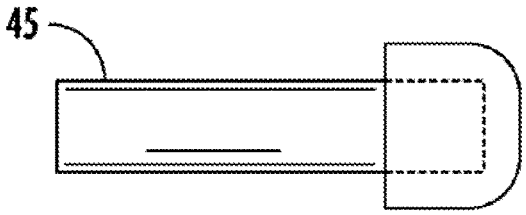
FIGS. 8*a*-8*c* are side elevational views of different embodiments of removably coupled ear inserts of the stereo headphone apparatus of FIG. 1.

Referring now more particularly to the master ear fitting 45 in FIG. 8*a*, the master ear fitting illustratively has an elongate shape for extending further into the ear canal of a user 55. The elongate shape of the master ear fitting 45 advantageously reduces reflection of sound caused by the ear canal 55 and improves sound quality at lower frequencies. The master ear fitting 45 may extend about 2-3 mm into the ear canal of a user 55 and may be particularly advantageous for a user with more severe hearing loss. Because the master ear fitting 45, which fits at the first bend of the ear canal of the user is closer to the eardrum, less amplification may be needed for a user with hearing loss.

Figure 8B:
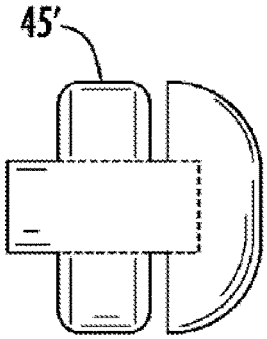

Referring now more particularly to the master ear fitting 45' in FIG. 8*b*, the master ear fitting is illustratively partially vented via an opening formed therein. The partial ventilation is particularly advantageous for a physically active user, for example. The ventilation allows air to penetrate the ear canal 55, which helps prevent moisture build-up. As will be appreciated by those skilled in the art, moisture build-up may reduce the quality and degrade the stereo audio, as well as provide discomfort for the user. In the case of a physically active user having a hearing loss, additional compensation for the hearing loss based upon moisture build-up may be not be needed. Additional openings may be provided and/or may be oriented differently as will be appreciated by those skilled in the art. In some instances, venting may be accomplished by configuring the master ear fitting 37 to be configured to have a diameter less than a diameter of the user's ear canal 55.

Figure 8C:
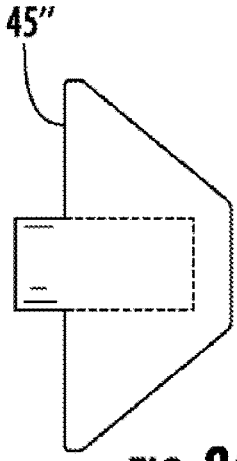

Referring now more particularly to the master ear fitting 45" in FIG. 8*c*, the master ear fitting is illustratively frusto-conical in shape and may be particularly useful for loud environments or while riding a motorized vehicle. The frusto-conical shape advantageously reduces external noises. Indeed, a user may listen to the stereo audio without having to increase the volume or in an effort to drown out the external or background noise. In the case of a user that suffers from hearing loss, this may reduce additional compensation for the hearing loss based upon the environmental noise. Of course, other ear fittings may be used, for example, an ear fitting may be formed for a user's ear based upon the amount of hearing loss and desired activities.

The slave audio output device 64 also includes a slave ear fitting 75. The slave ear fitting is similar to the master ear fitting, and is coupled to the slave E/A transducer 76. As will be appreciated by those skilled in the art, while different embodiments of the master ear fitting 45 have been described above, the different embodiments of the master ear fitting are also applicable to the slave ear fitting for coupling to the slave E/A transducer 76.

Figure 9:
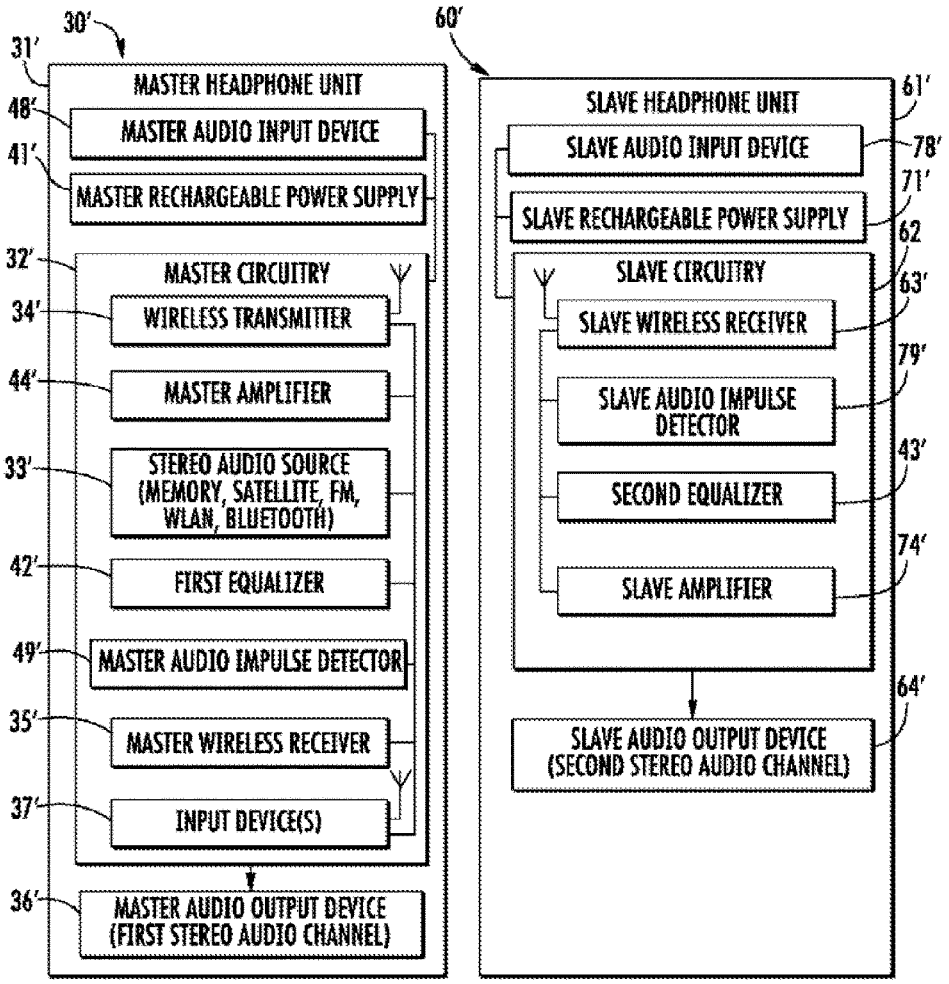
FIG. 9 is a schematic block diagram of another embodiment of the stereo audio headphone apparatus in accordance with the present invention.

Referring now to FIG. 9, in another embodiment, the master headphone unit 30' may also include a master audio input device 48', for example, an audio input transducer or microphone, carried by the master housing 31'. The master circuitry 32' is also operable in a pass-through mode with the audio sensed by the master audio input device 48' being delivered to the master audio output device 36' via the first independently settable equalizer 42'. The first independently settable equalizer 42' is illustratively carried by the master housing 31'. In other words, in the pass-through mode, the master headphone unit 30' functions similar to a hearing aid.

The master circuitry 32' is also operable in an impulse noise rejecting pass-through mode. More particularly, the master circuitry may include an independent master audio impulse detector 49' to permit independent selection of frequency equalization, or audio volume, for a detected audio impulse detected from the master audio input device 48'. For example, an audio impulse may include a backfire from a vehicle, a gunshot, or other impulse noise. The independent master audio impulse detector 49' advantageously can compress a loud audio impulse in a relatively small time period, for example, a few milliseconds. For example, in the case of a gunshot, the associated audio impulse may be independently compressed to a reduced sound level.

As will be appreciated by those skilled in the art, independent audio impulse detection advantageously reduces further hearing loss to a user that has hearing loss, or may reduce the chances of developing hearing loss in a user that may not have hearing loss.

Still further, in the case where a user tilts their head toward their shoulder to fire a gun, the ear adjacent the user's shoulder may be more protected than the user's other ear, and thus may require less audio volume compensation or audio volume attenuation. Independent audio volume compensation or attenuation based upon a detected impulse advantageously allows for audio volume compensation or attenuation for each ear independently, for example. Moreover, the advantages of the independent audio impulse detection combined with the independent selection of frequency equalization to compensate for hearing loss of a user may provide an appropriate or desired compensation level for the hearing impaired user, as compared to prior art stereo audio headphones.

Of course, the master circuitry 32' may be selectively operated to provide one or a combination of the independent selection of frequency equalization of stereo audio data provided by the stereo audio source 33', independent selection of frequency equalization based upon a detected audio impulse, and independent selection of frequency equalization of the audio sensed by the master audio input device 48'.

The slave headphone unit 60' may also include a slave audio input device 78', for example, an audio input transducer or microphone, carried by the slave housing 61'. Similar to the master circuitry 32', the slave circuitry 62' is also operable in a pass-through mode with the audio sensed by the slave audio input device 48' being delivered to the slave audio output device 64' via the second independently settable equalizer 43'. The second independently settable equalizer 43' is carried by the slave housing 61'. The slave circuitry 62' may also include a slave audio impulse detector 79' and may also be operable in an impulse noise rejecting pass-through mode to reject impulse noise. Of course, the slave circuitry 62' may also be operated in conjunction with the master circuitry 32' to be operated in any or a combination of modes.

Moreover, in this embodiment, since the second equalizer 43' is carried by the slave housing 62', the wireless transmitter 34' may also transmit commands relating to the independent selection of the frequency equalization for the second stereo audio channel to compensate for hearing loss of a user. The stereo audio from the stereo audio source 33' may also be sent in addition to the commands relating to the independent selection of the frequency equalization. Other commands, such as those relating to the operation mode of the slave circuitry, for example, may also be sent.

Figure 10:
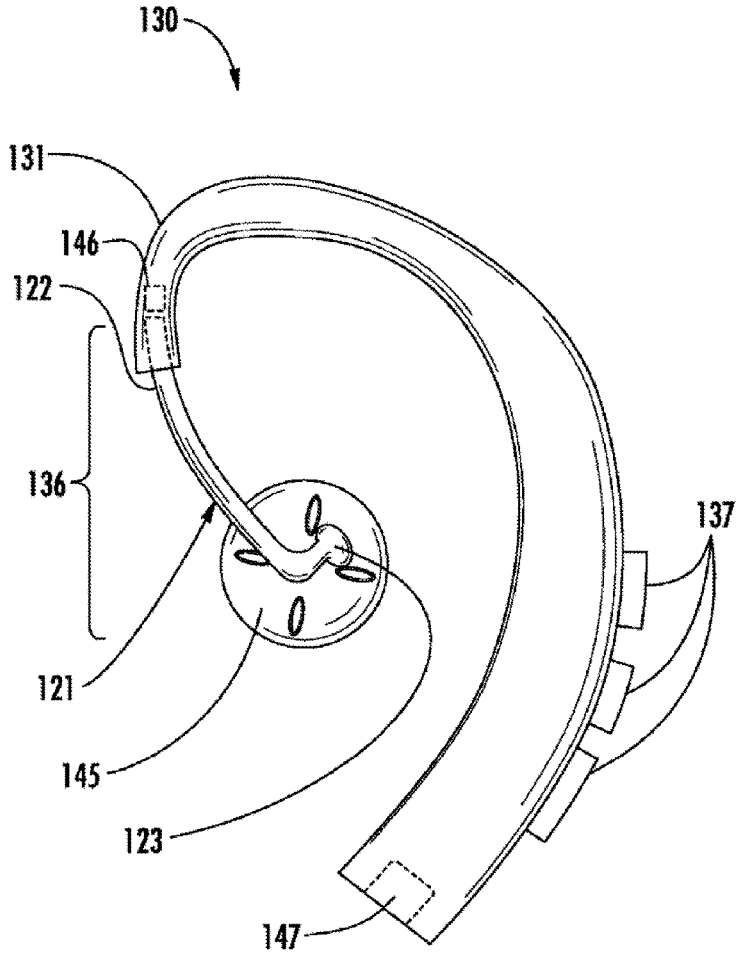
FIG. 10 is a side elevational view of another embodiment of a stereo audio headphone unit in accordance with the present invention.
Figure 11:
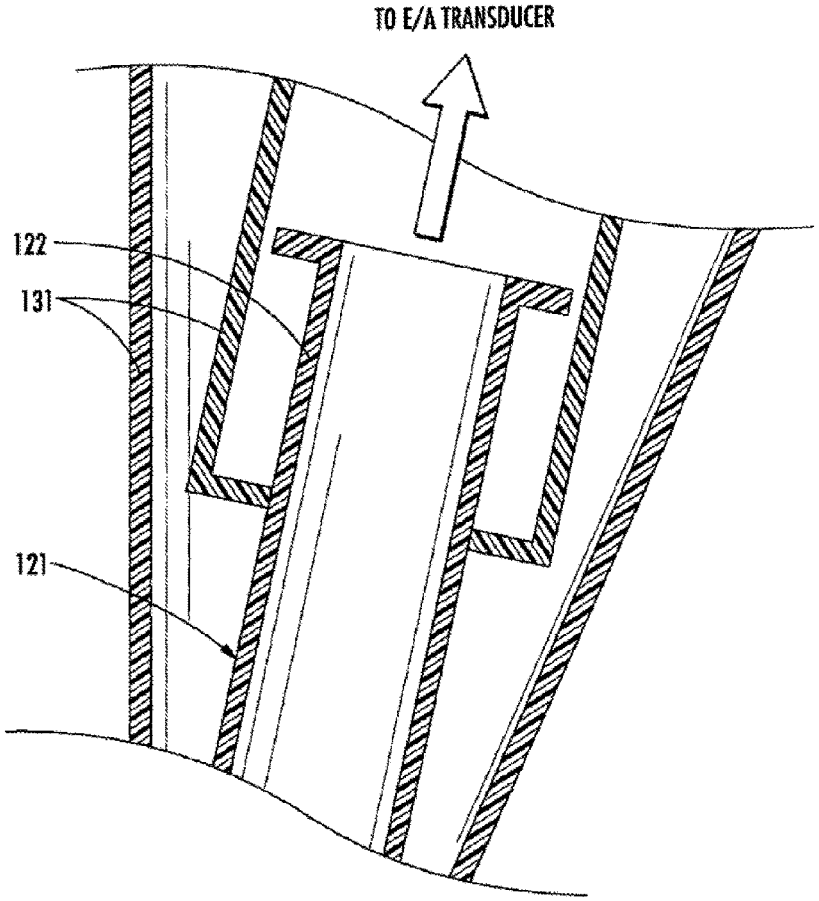
FIG. 11 is an enlarged cross-sectional view of the stereo audio delivery tube and housing of the stereo audio headphone unit of FIG. 10.

Referring now to FIGS. 10-11, another embodiment of the stereo audio headphone apparatus for a user having hearing loss is illustrated. Illustratively, the master headphone unit 130 includes a master housing 131 that does not extend to the opening of the user's ear canal. Instead, the master housing 131 ends at the front of the user's ear, or the root of the helix of the user's ear, as will be appreciated by those skilled in the art.

The master audio output device 136 includes a master E/A transducer 146 and a master audio delivery tube 121. The master audio delivery tube 121 illustratively has a proximal end 122 coupled to the master E/A transducer 146, and a distal end 123 positioned adjacent the ear canal of the user. The master audio delivery tube 121 is illustratively round in shape. However, the master audio delivery tube 121 is not limited to a round shape. Other sizes and shapes of stereo audio carrying tubes may be used, and may depend on the extent and type of the user's hearing loss and desired application.

The master audio delivery tube 121 advantageously increases comfort to the user by allowing the use of a master ear fitting 145 that is smaller than the ear canal of the user to be used. Additionally, the master audio delivery tube 121 and corresponding master ear fitting 145 may also provide increased comfort in certain activities, for example, activities using a helmet. Indeed, the pressing of the hard plastic of the master housing 131 is reduced in the area in front of the ear. Additionally, using the master audio delivery tube 121 reduces the overall weight of the master headphone unit 130, and thus may reduce the overall cost of manufacture.

The master audio delivery tube 121 is selectively extendable from adjacent portions of the master housing 131 (FIG. 10). More particularly, the master housing 131 illustratively has an opening formed therein to allow the master audio delivery tube 121 to slidably adjust to accommodate different sizes of a user's ear. In other words, the master audio delivery tube 121 is extendable for positioning within the opening of the ear canal, for example, adjacent the miadis. As will be appreciated, the proper fitment may provide additional compensation for a user having a hearing loss.

A master ear fitting 145 is coupled to the distal end 123 of the master audio delivery tube 121. The master ear fitting 145 is illustratively sized to fit within the ear canal of the user and includes a plurality of openings therein for ventilation.

Similar to the master audio output device 136, the slave audio output device (not shown) also includes a slave E/A transducer (not shown) and a slave audio delivery tube (not shown) having a proximal end coupled to the slave E/A transducer and a distal end to be positioned adjacent another ear canal of the user.

Figure 12:
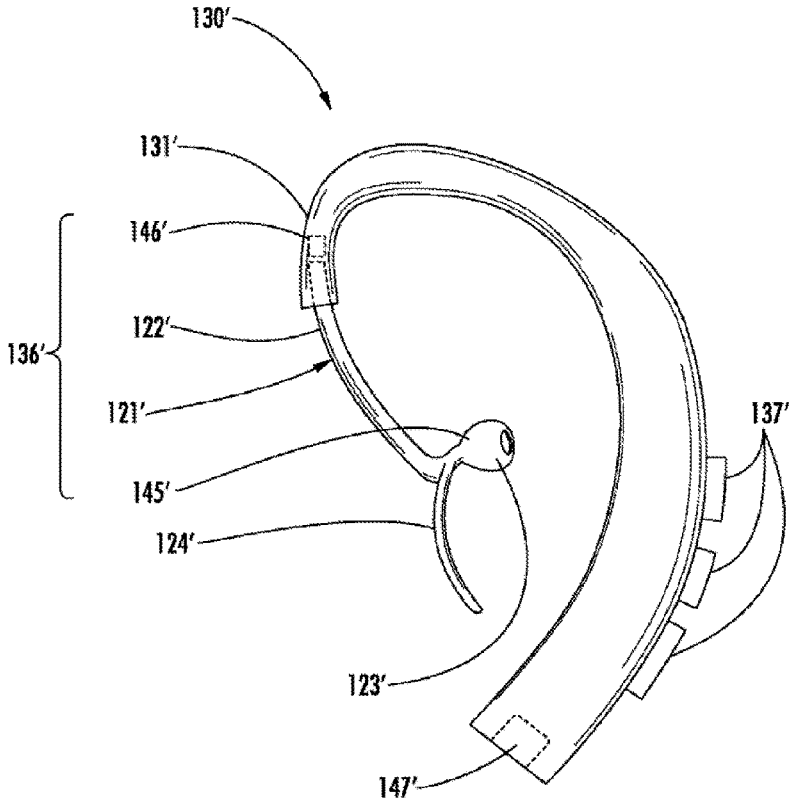
FIG. 12 is a side elevational view of another embodiment of a stereo audio headphone unit in accordance with the present invention.

Referring now to FIG. 12, in another embodiment the master ear fitting 145' has a curved shape and is positioned near the top of the user's ear canal. The master ear fitting 145' does not entirely fill the user's ear canal to provide the ventilation. Of course, with any of the embodiments described herein, other ear fittings may be used, for example, as described above with reference to FIGS. 7-8.

A biasing clip 124' may be optionally coupled to the distal end 123' of the master audio delivery tube 121' and may sit in the conchal bowl of the user's ear, (i.e. the bottom of the opening of the user's ear) to improve security and fitment. The biasing clip 124' may be desirable for a user having a hearing loss that participates in impact sports or activities. As will be appreciated by those skilled in the art, the slave headphone unit (not shown) may be similarly configured.

Figure 13:
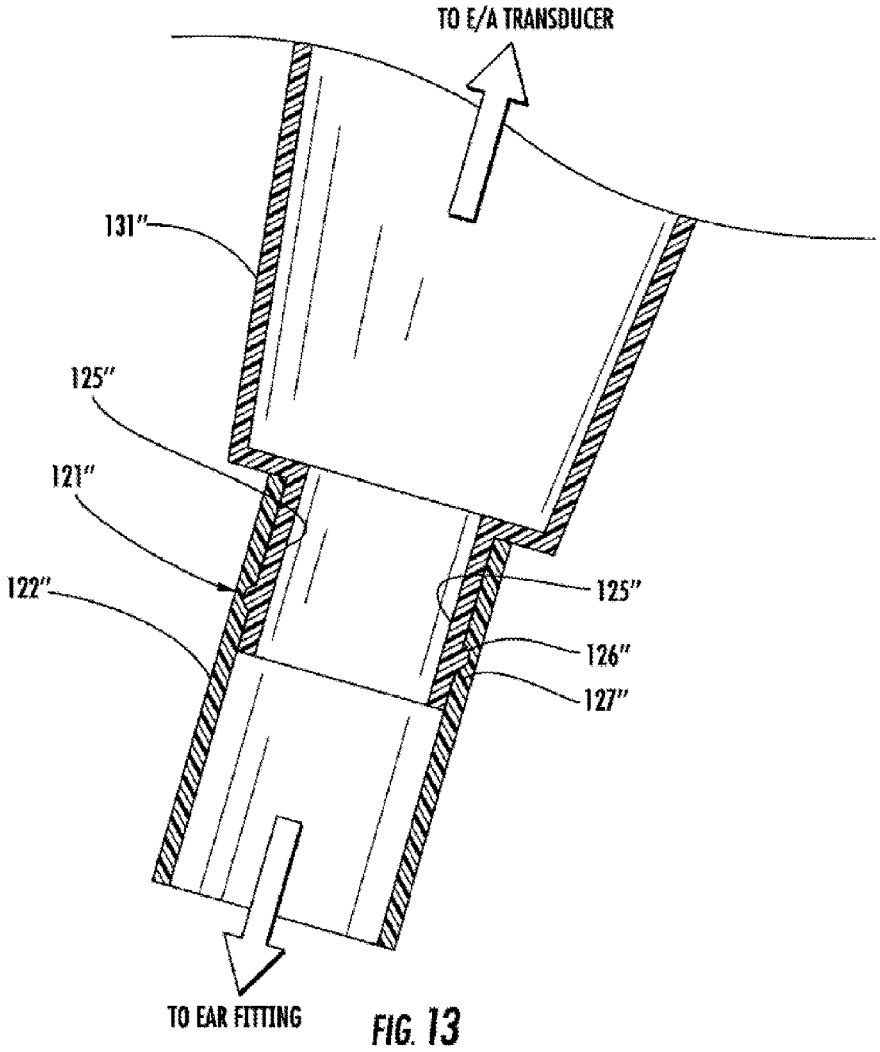
FIG. 13 is an enlarged cross-sectional view of another embodiment of the stereo audio headphone unit of FIG. 10.

Referring now to FIG. 13, in another embodiment, the proximal end 122" of the master audio delivery tube 121" is removably coupled to the master E/A transducer 146". More particularly, the master audio delivery tube 121" is coupled to an external master audio delivery tube coupling port 125". The external master audio delivery tube coupling port 125" may include a circumferential protrusion 126" for coupling to a corresponding circumferential cut 127" in the master audio delivery tube 121". As will be appreciated by those skilled in the art, different sized master audio delivery tubes may be used, both in length and diameter. Still further, other types of coupling arrangements between the master audio delivery tube 121" and the master E/A transducer 146" may be used. The slave headphone unit (not shown) may be configured similarly to the master headphone unit 130".

A method aspect is directed to a method for compensating for hearing loss of a user. The method includes providing a master headphone unit 30 that includes a master housing 31 to be independently carried behind an ear 38 of the user and master circuitry 32 carried by the master housing. The master circuitry 32 includes a stereo audio source 33 and a wireless transmitter 34 coupled thereto. A master audio output device 36 is carried by the master housing 31 and coupled to the master circuitry 32 for playing a first stereo audio channel from the stereo audio source 33.

The method also includes providing a slave headphone unit 60 that includes a slave housing 61 to be independently carried behind another ear 68 of the user, and slave circuitry 62 carried by slave housing. The slave circuitry 62 includes a wireless receiver 63 cooperating with the wireless transmitter 34 and a slave audio output device 64 carried by the slave housing 61 and coupled to the slave circuitry for playing a second stereo audio channel from the stereo audio source.

The method further includes independently setting first and second independently settable frequency equalizers 42, 43 for the first and second stereo audio channels to compensate for the hearing loss of the user.

The stereo audio headphone apparatus 20 may be particularly advantageous to a user having hearing loss that may wish to listen to music, for example, by permitting independent selection of frequency equalization. In other words, a user having hearing loss may be able to portably enjoy a full spectrum of stereo audio (i.e. music) by individually adjusting the stereo audio for their hearing loss and/or desired acoustical preferences.

Moreover, the stereo audio headphone units 30, 60 advantageously are wireless and have a relatively low profile behind the ear. This increases user comfort in wearing the stereo audio headphones, and may be particularly advantageous in activities involving wearing of a helmet and in activities involving a range of body movements, for example. More particularly, the wireless operation of the stereo audio headphones may be particularly useful during a workout or during a run, for example, on a treadmill. As will be appreciated by those skilled in the art, interference with movement, from wires, for example, is reduced.

Even still further, in some embodiments, the stereo audio headphone apparatus 20 advantageously may reduce noise that may be potentially damaging to a user's ear, for example, an impulse noise. Reducing an impulse noise may protect a user that does not have hearing loss from developing a hearing loss from the impulse noise, either temporary or permanent, while protecting against further hearing loss from the impulse noise in a user that has a hearing loss.

The advantages of the stereo audio headphones, along with the pass-through mode and with the desired fitment of the ear fitting further provide increased hearing loss compensation of stereo audio for a desired application. Thus, the stereo audio headphone apparatus 20 may improve the overall listening experience of a user. Indeed, while the stereo audio headphone apparatus 20 may be beneficial to any user, the stereo audio headphones may be particularly beneficial to a user having hearing loss.

It is noted that in different embodiments, certain elements are described with regard to the master headphone unit 30. While these elements may not have been specifically described with regard to the slave headphone unit 60, as will be understood by those skilled in the art, the elements that are present in the master headphone unit 30 may also present in the slave headphone unit, for example, an input device, an audio input device, a power source, a recharging station port, and an independent audio impulse detector. The operation of these elements is similar to the corresponding ones in the master headphone unit 30, as will be appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A stereo audio headphone apparatus comprising:

a master headphone unit comprising:

a master housing to be independently carried behind an ear of the user, master circuitry carried by said master housing and comprising a stereo audio source and a wireless transmitter coupled thereto, a master audio output device carried by said master housing and coupled to said master circuitry for playing a first stereo audio channel from said stereo audio source, a master audio input device carried by said master housing and coupled to said master circuitry, and a first independently settable frequency equalizer for the first stereo audio channel carried by said master housing; and a slave headphone unit comprising a slave housing to be independently carried behind another ear of the user, slave circuitry carried by said slave housing and comprising a wireless receiver cooperating with said wireless transmitter, a slave audio output device carried by said slave housing and coupled to said slave circuitry for playing a second stereo audio channel from said stereo audio source, a slave audio input device carried by said slave housing and coupled to said slave circuitry, and a second independently settable frequency equalizer for the second stereo audio channel carried by said slave housing;

wherein said master circuitry is operable in a pass-through mode with audio sensed by said master audio input device being delivered to said master audio output device via said first independently settable frequency equalizer; and wherein said slave circuitry is operable in a pass-through mode with audio sensed by said slave audio input device being delivered to said slave audio output device via said second independently settable frequency equalizer.

2. The stereo audio headphone apparatus according to claim 1, wherein said master circuitry is operable in an impulse noise rejecting pass-though mode to reject impulse noise; and wherein said slave circuitry is also operable in the impulse noise rejecting pass-though mode.

3. The stereo audio headphone apparatus according to claim 1, wherein the master circuitry comprises a master audio impulse detector.

4. The stereo audio headphone apparatus according to claim 3, wherein the master audio impulse detector is configured to independently attenuate an output of the master audio output and the master slave output independently.

5. The stereo audio headphone apparatus according to claim 1, wherein each of the master circuitry and the slave circuitry is selectively operable to provide one or a combination of the independent selection of frequency equalization of stereo audio data provided by the stereo audio source, independent selection of frequency equalization based upon a detected audio impulse, and independent selection of frequency equalization of audio sensed by one of the master audio input device and the slave audio input device.

6. The stereo audio headphone apparatus according to claim 1, wherein said master audio output device comprises a master electrical-to-acoustical (E/A) transducer, and a master audio delivery tube having a proximal end coupled to said master E/A transducer and a distal end to be positioned adjacent an ear canal of the user; and wherein said slave audio output device comprises a slave E/A transducer, and a slave audio delivery tube having a proximal end coupled to said slave E/A transducer and a distal end to be positioned adjacent another ear canal of the user.

7. The stereo audio headphone apparatus according to claim 6, wherein said master audio output device further comprises a master ear fitting coupled to the distal end of said master audio delivery tube; and wherein said slave audio output device further comprises a slave ear fitting coupled to the distal end of said slave audio delivery tube.

8. The stereo audio headphone apparatus according to claim 7, wherein said master audio delivery tube is selectively extendible from adjacent portions of said master housing; and wherein said slave audio delivery tube is selectively extendible from adjacent portions of said slave housing.

9. The stereo audio headphone apparatus according to claim 7, wherein each of the master ear fitting and the slave ear fitting are at least partially vented.

10. The stereo audio headphone apparatus according to claim 7, further comprising a first biasing clip coupled to a distal end of the master audio delivery tube.

11. The stereo audio headphone apparatus according to claim 1, wherein said master audio output device comprises a master electrical-to-acoustical (E/A) transducer to be positioned adjacent an ear canal of the user; and wherein said slave audio output device comprises a slave E/A transducer to be positioned adjacent another ear canal of the user.

12. The stereo audio headphone apparatus according to claim 11, wherein said master audio output device further comprises a master ear fitting coupled to said master E/A transducer; and wherein said slave audio output device further comprises a slave ear fitting coupled to said slave E/A transducer.

13. The stereo audio headphone apparatus according to claim 1, wherein said master housing has an arcuate shape; and wherein said slave housing also has an arcuate shape.

14. The stereo audio headphone apparatus according to claim 1, further comprising a remote control unit operatively coupled to at least one of said master and slave headphone units.

15. The stereo audio headphone apparatus according to claim 1, wherein said master headphone unit comprises a master rechargeable power supply coupled to said master circuitry; wherein said slave headphone further comprises a slave rechargeable power supply coupled to said slave circuitry; and further comprising a recharging station to receive said master and slave headphone units for recharging said master and slave rechargeable power supplies, respectively.

* * * * *